US009695618B2

(12) United States Patent
Bendel et al.

(10) Patent No.: US 9,695,618 B2
(45) Date of Patent: Jul. 4, 2017

(54) MOTOR VEHICLE DOOR LOCK

(71) Applicant: Kiekert Aktiengesellschaft, Heiligenhaus (DE)

(72) Inventors: Thorsten Bendel, Oberhausen (DE); Claus Topfer, Sindelfingen (DE)

(73) Assignee: Kiekert Aktiengesellschaft, Heiligenhaus (DE)

( * ) Notice: Subject to any disclaimer, the term of this patent is extended or adjusted under 35 U.S.C. 154(b) by 334 days.

(21) Appl. No.: 14/386,135

(22) PCT Filed: Mar. 14, 2013

(86) PCT No.: PCT/DE2013/000144
§ 371 (c)(1),
(2) Date: Sep. 18, 2014

(87) PCT Pub. No.: WO2013/139323
PCT Pub. Date: Sep. 26, 2013

(65) Prior Publication Data

US 2015/0048624 A1 Feb. 19, 2015

(30) Foreign Application Priority Data

Mar. 20, 2012 (DE) ..... 20 2012 002 858 U

(51) Int. Cl.
*E05C 19/06* (2006.01)
*E05B 85/20* (2014.01)
(Continued)

(52) U.S. Cl.
CPC ..... *E05B 85/20* (2013.01); *E05B 15/0053* (2013.01); *E05B 79/08* (2013.01);
(Continued)

(58) Field of Classification Search
CPC ..... E05B 15/0053; E05B 79/08; E05B 85/01; E05B 85/06; E05B 85/20; Y10S 292/60; Y10S 292/61
(Continued)

(56) References Cited

U.S. PATENT DOCUMENTS 1,088,526 A * 2/1914 Brae ..... E05B 17/2092 292/209
1,481,501 A * 1/1924 Britten ..... E05C 17/443 292/209
(Continued)

FOREIGN PATENT DOCUMENTS

CH EP 1201857 A1 * 5/2002 ..... E05C 17/34
DE 4318557 * 8/1994
(Continued)

OTHER PUBLICATIONS

Machine Translation of DE102007048452A1 by LexisNexis Total Patent dated Sep. 18, 2014.
(Continued)

*Primary Examiner* — Carlos Lugo
(74) *Attorney, Agent, or Firm* — Woodard, Emhardt, Moriarty, McNett & Henry LLP

(57) ABSTRACT

The invention relates to a motor vehicle door lock comprising an actuation/locking lever mechanism, with a first lever and a second lever, both levers being couplable with each other in at least two different relative positions. At least the one, first lever comprises a detent spring connected thereto for engagement with at least one detent recess on the other, second lever.

17 Claims, 2 Drawing Sheets

(51) Int. Cl.

| | |
|---|---|
| ***E05B 79/08*** | (2014.01) |
| ***E05B 85/00*** | (2014.01) |
| ***E05B 15/00*** | (2006.01) |
| *E05C 19/00* | (2006.01) |
| *E05B 85/06* | (2014.01) |
| *E05B 81/06* | (2014.01) |

(52) U.S. Cl.
CPC ..... *E05B 85/01* (2013.01); *E05B 81/06* (2013.01); *E05B 85/06* (2013.01); *Y10S 292/60* (2013.01); *Y10S 292/61* (2013.01); *Y10T 292/09* (2015.04)

(58) Field of Classification Search
USPC ..... 292/80–91, 152, 209, 303
See application file for complete search history.

(56) References Cited

U.S. PATENT DOCUMENTS 1,760,491 A * 5/1930 Grund ..... E05B 83/36 292/139
1,841,890 A * 1/1932 Hannon ..... E05C 17/443 292/204
1,991,120 A * 2/1935 Rightmyer ..... E05B 85/22 292/153
2,501,940 A * 3/1950 Hibbard ..... A47J 45/071 16/425
3,762,750 A * 10/1973 Orr ..... E05B 63/0017 292/140
3,848,909 A * 11/1974 Foley ..... E05B 79/12 292/216
4,810,014 A * 3/1989 McGourty ..... E05B 47/0012 292/144
5,088,781 A * 2/1992 Ono ..... E05B 1/04 292/347
6,056,359 A * 5/2000 Clark ..... B63B 29/04 292/76
6,578,446 B2 * 6/2003 Staser ..... E05B 79/12 292/1
7,213,426 B2 * 5/2007 Qing ..... E05B 17/2053 292/139
8,444,190 B2 * 5/2013 Schmidt ..... E05B 13/105 292/102
8,584,541 B2 * 11/2013 Sokolofsky ..... B60H 1/00857 74/470

FOREIGN PATENT DOCUMENTS

| | | | | | |
|---|---|---|---|---|---|
| DE | 8916180 | U1 | | 8/1994 | |
| DE | 29516846 | U1 | * | 12/1995 | ..... E05B 3/06 |
| DE | 102007048452 | A1 | | 11/2008 | |
| DE | CA 2865309 | A1 | * | 9/2013 | ..... E05B 79/10 |
| EP | 1001119 | A1 | | 5/2000 | |
| FR | EP 0854260 | A1 | * | 7/1998 | ..... E05B 15/0053 |
| FR | 2762640 | A1 | * | 10/1998 | ..... E05B 15/0053 |
| GB | 746224 | A | * | 3/1956 | ..... E05B 15/0053 |
| GB | 820352 | A | * | 9/1959 | ..... E05B 5/00 |
| JP | S6090364 | U | | 6/1985 | |
| JP | 08218710 | A | * | 8/1996 | |

OTHER PUBLICATIONS

Machine Translation of DE8916180U1 by LexisNexis Total Patent dated Sep. 18, 2014.
Machine Translation of EP1001119A1 by LexisNexis Total Patent dated Sep. 18, 2014.

* cited by examiner

MOTOR VEHICLE DOOR LOCK

REFERENCE TO RELATED APPLICATIONS

This application is the U.S. national stage application of International Patent Application No. PCT/DE2013/000144, filed Mar. 14, 2013, which claims priority of German Application No. 20 2012 002 858.8, filed Mar. 20, 2012, which are both hereby incorporated by reference.

BACKGROUND

The invention relates to a motor vehicle door lock with an actuation/locking lever mechanism with a first lever and a second lever with both levers being couplable with each other in at least two different relative positions.

The prior art disclosed in DE 2 355 556 A describes a motor vehicle door lock with a locking mechanism containing a tong case with two tong arms. The two tong arms are mounted respectively on bolts. In addition, a spring is provided that is supported by the two bolts of the tong arms.

The generic state of the art according to DE 89 16 180 U1 discloses two levers, a coupling lever and an actuating lever that can be coupled to each other and in different relative positions. One relative position corresponds to the coupled state, whilst another relative position corresponds to the uncoupled state. In principle, this arrangement has proven to be successful. The known solution requires, however, a kinematically complicated design and is hardly suitable for other applications as the change in coupling position is achieved by a double stroke activation.

In more modern motor vehicle door lock versions equipped with a so-called quick release function, this quick release function ensures that the actual unlocking operation carried out by a motor is shortened, for instance as part of a so-called "keyless entry" function. For this purpose, various actuating operations are required, with the aid of which the actuating lever chain is directly moved into the unlocked state or a previously interrupted mechanical connection to the release lever is produced (see DE 10 2005 043 227 B3). This arrangement has generally been successful can, however be improved as regards the coupling used between the levers integrated in the quick release unit. Indeed there is the general possibility or even danger with this arrangement that two levers coupled during this process are not exactly aligned with each other in their relative position, resulting in malfunctioning. The invention seems to remedy this situation.

The invention is based on the technical problem of developing such a motor vehicle door lock further in such a way that the coupling of the two levers functions correctly and is produced with little effort.

SUMMARY

In order to solve this problem, a generic motor vehicle door lock of the invention is characterized by at least the first lever containing a connected detent spring for engagement with at least one detent recess in the other, second lever.

In most cases, the lever with the detent spring is designed as a fixed lever. This means that the first lever or fixed lever with the connected detent spring typically does not change its position in relation to the second lever. In contrast, the second lever containing the detent recess and being arrangeable in different detent positions in relation to the fixed lever, is designed as a detent lever. As the detent lever can, for instance take up a base position and a deflection position in relation to the fixed lever, a quick release function can be provided amongst other things. In the base position, the detent lever or quick release lever may not act on a triggering lever, whilst the deflection position of the detent lever or of the quick release lever corresponds to the detent lever being able to act on the triggering lever, in order to disengage a locking mechanism with its help. The deflection position of the detent lever in relation to the fixed lever can be set by a motor or manually and within a very short time.

In this way a quick release mechanism can be provided which in a very short time allows an operator to act upon the triggering lever in such a way via a handle and the actuation lever mechanism that the desired opening of the locking mechanism becomes possible. In contrast, a central locking drive also provided, requires considerably more time to be moved from its "locked" into its "unlocked" position.

The aforementioned detent spring connected to the first lever typically contains a detent cam and a spring extension arm. The spring extension arm is generally connected to the first lever. This can be achieved by using usual connecting methods, such as riveting, bolting, etc. In general it is also possible, for the spring extension arm and the first lever to be designed as a single part. In this case, the first lever and the spring extension arm or the first lever including the detent lever can be produced and designed in a single common production process.

The first lever with the detent spring is, as explained, designed as a fixed lever and the second lever with the detent recess is designed as a detent lever arrangeable in different detent positions in contrast to the fixed lever. Generally at least two detent positions can be provided, i.e. the already described base position and the deflection position of the detent lever in relation to the fixed lever. In general, the detent lever is mounted on the fixed lever in a rotation axis. Furthermore, the arrangement is such that the detent spring generates a spring force acting on the detent lever in the area of the axis of rotation. At the same time, the spring extension arm can generally be connected to the fixed lever on the same plane or also on another plane. As part of the latter option it has proven to be advantageous for the spring extension arm to be arranged perpendicular to the plane of the fixed lever.

As a result of the detent spring advantageously producing a spring force on the detent lever, the detent cams of the detent spring on the side of the detent lever can engage in the one or several detent recesses provided at this point. In most cases, several detent recesses are arranged on the detent lever in the area of the axis of rotation. The detent recesses can indeed be radially arranged in relation to the axis of rotation, so that the detent lever can be fixed in various radial positions in relation to the fixed lever. In every radial position the detent cams of the detent spring engages in the respective detent recess on the detent lever.

Apart from the option that the detent cams of the detent spring on the side of the detent lever engage in the provided detent recesses, there is furthermore the option of the detent cams of the detent spring engaging in the detent recess perpendicularly to the detent lever. In this case, the detent recess can in principle be provided over the entire surface of the detent lever, including along the edge. In contrast, the lateral engagement of the detent cams of the detent spring on the detent lever requires that the detent recess is arranged on the edge of the detent lever.

The detent cam is typically a projection connected to the spring extension arm. The projection and the spring extension arm can be designed as a single part. The same applies for the projection, the spring extension arm and the respective fixed lever. Alternatively, the detent cam can also be provided in form of a U-shaped or V-shaped design of the detent spring. In this case, the detent cam is generally defined in the detent spring by an additional manufacturing process, such as deep drawing.

In addition to the spring extension arm with the connected detent cam, the detent spring often has a switching arm. The switching arm can be arranged at an angle in comparison to the spring extension arm. A perpendicular arrangement of the arms has proven to be particular successful. It is, however, also possible that the switching arm is arranged as an extension of the spring extension arm and thus co-linearly to said arm. In this case, the switching arm and the spring extension arm form a rocker or actuation rocker in relation to the articulated point between the detent spring and the fixed lever.

In order to absorb high loads between the fixed lever and the detent lever, the detent spring or its spring extension arm can contain an additional catch. In contrast to the projection connected to the spring extension, the additional catch engages in a recess fixed in relation to the housing. In most cases it has proven to be advantageous if the additional catch is arranged between said articulated point of the detent spring and fixed lever or the spring extension arm and the projection. In this way, any forces applied between the fixed lever and the detent lever are absorbed particularly effectively.

As already explained, the detent lever can generally be a quick release lever. The fixed lever and the detent lever are also in most cases arranged parallel to each other. Generally, the detent lever can also be tilted in relation to the fixed lever and then has an angled, for instance, a perpendicular arrangement. In any case, a particularly simple and reliably working engaging connection is provided between the fixed lever and the detent lever, which is also suitable for providing a quick release.

For this purpose the detent lever is pivoted from, for instance its base position opposite the fixed lever into the deflection position. In this deflection position, the detent lever can now act upon a triggering lever which in turn opens the locking mechanism. For this purpose the fixed lever can be acted upon by a handle, so that the desired function can be observed via the detent lever in the deflection position. These are the main advantages of the invention.

Below, the invention is explained in detail with reference to only one embodiment, in which:

DETAILED DESCRIPTION OF THE DRAWINGS

Figure 1:
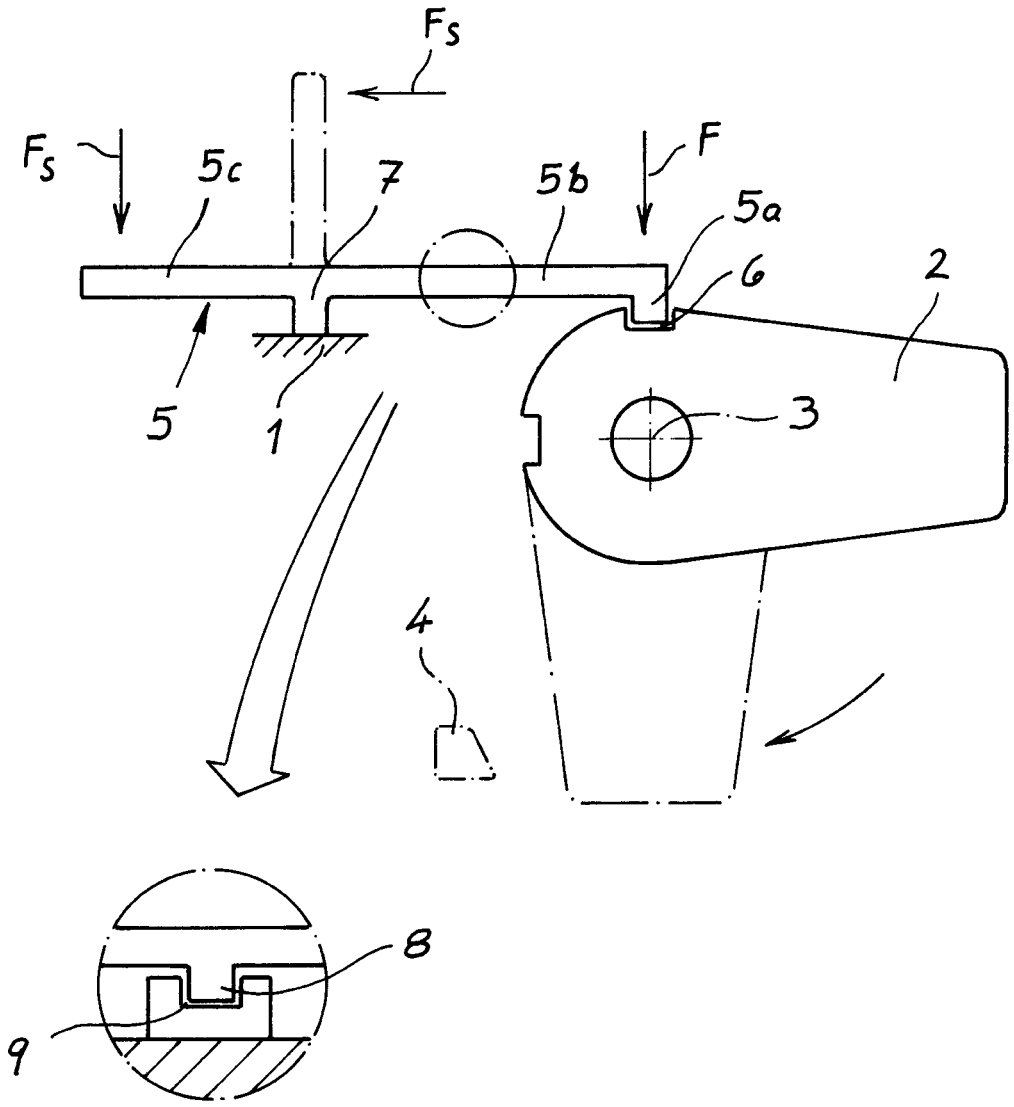
FIG. 1 shows a first embodiment of the invention.

In general the figures show a motor vehicle door lock comprising an actuation lever mechanism 1 and a locking lever mechanism 2. The actuation lever mechanism 1 contains a first lever or a fixed lever 1 as well as other levers, not shown. The actuation lever mechanism 1 can also include a handle (internal and/or external door handle).

Only a second lever 2 or detent lever 2 of the locking lever mechanism 2 is shown. The detent lever 2 is mounted on the fixed lever 1 in a rotation axis 3. Although the rotation axis 3 can be fixed in relation to the housing, this is not absolutely necessary. The detent lever 2 can be pivoted into base position indicated by a solid line in FIG. 1 and a deflection position (dashed-dotted line) in relation to the fixed lever 1.

The deflection position, indicated by a dashed or dash-dotted line in FIG. 1 of the detent lever 2 corresponds to the detent lever 2 now being able to act on a triggering lever 4, whilst the detent lever 2 in its base position, shown by the solid line, is not able to do so. A locking mechanism, not shown, can be opened with the aid of the triggering lever 4. The triggering lever 4 actually acts on a pawl, lifting it off a rotary latch. The rotary latch opens with the aid of a spring and releases a previously retained locking pin. As a result, a respective motor vehicle door can be opened as part of a so-called quick release function.

The detent lever 2 is in this case designed as a quick release lever although the invention is not limited to this. In the base position, as indicated by the solid line in FIG. 1, any actuation of the triggering lever 4 by the actuation lever mechanism 1 has no effect and this corresponds to the functional position "locked". When, however, the detent lever 2 takes up its dashed-dotted position in FIG. 1 as a result of being acted upon manually and/or by a motor, pivoting of the fixed lever 1 around the axis of rotation 3 in the sense of a clockwise movement indicated in FIG. 1, allows the actuating lever 4 to be acted upon, as described. As a result, an associated motor vehicle door can be opened as part of a quick release function. The described pivoting process of the detent lever 2 occurs, in deed, nearly without any delay in contrast to the usual unlocking process.

In order to actually achieve this functionality. the two levers 1, 2 can be coupled in at least two different relative positions, the aforementioned base position and the deflection position. For this purpose, the first lever or fixed lever 1 contains a connected detent spring 5. The detent spring 5 is provided to selectively engage in the detent recesses 6 or 6*a* on the other second lever or detent lever 2. From FIG. 1 it is apparent that the detent spring 5 contains a detent cam 5*a* and a spring extension arm 5*b*. In addition, the detent spring 5 can also contain a switching arm 5*c* described in more detail below.

Figure 3:
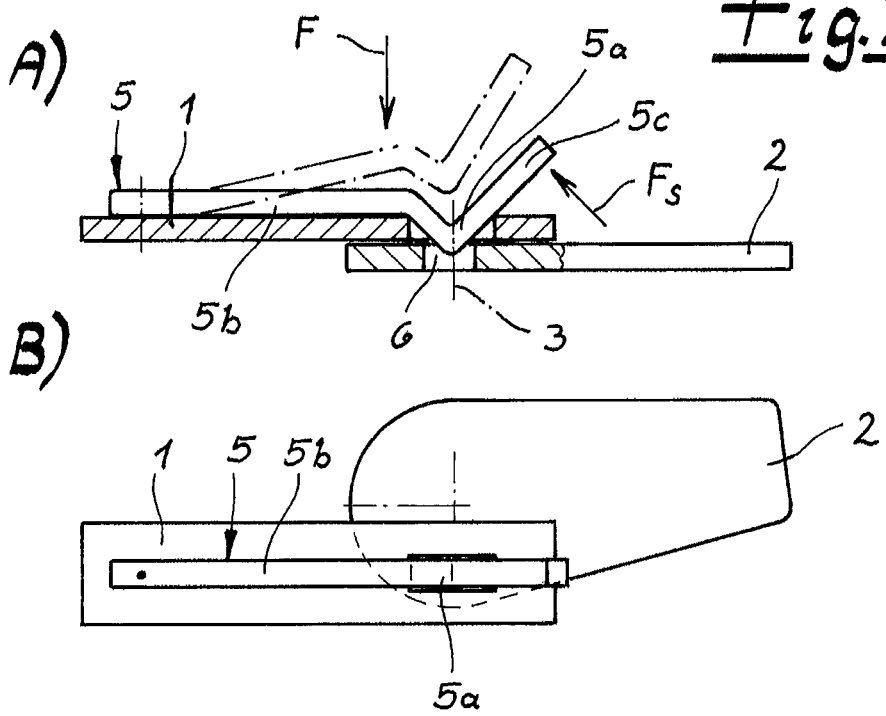
FIG. 3*a* shows a cross section of a further modified version.
FIG. 3*b* shows a view from the top onto the version of FIG. 3*a*.

The spring extension arm 5*b* is connected to the first lever or fixed lever 1 at an articulated point 7. The detent cam 5*a* engages in one of the detent recess 6 on the second lever or detent lever 2. The detent cam 5*a* and detent recesses 6 and 6*a* can each have a rectangular cross section, as shown in the example of FIG. 1. In this case, the detent cam 5*a* is designed as a projection 5*a* connected to the spring extension arm 5*b*. In general, the detent cam 5*a* can, however, also be provided in form of a U-shaped or V-shaped design of the detent spring or of the spring extension arm 5*b*. This is shown in the examples of FIGS. 3*a* and 3*b*.

This means that in this case, the detent cam 5*a* is defined on spring extension arm 5*b* by an additional production process, in most cases a deep drawing process. As already explained, the second lever or detent lever 2 with detent recesses 6 and 6*a* can be arranged in different detent positions in relation to the first lever or fixed lever 1 with detent spring 5 based on which detent recess 6 or 6*a* that detent cam 5*a* engaged in. For this purpose, the detent spring 5 typically produces a spring force F in the area of the rotation axis 3 acting on detent lever 2. In the example of FIG. 1 the spring force F acts radially in relation to rotation axis 3. In the embodiment shown in FIG. 2*a*, spring force F acts in axial direction. The same applies to the embodiment of FIG. 3*a*.

Different options exist for providing the interaction between the detent spring 5 and the detent recesses 6 and 6*a*. The detent spring 5 with its detent cam 5*a* on the side of the detent lever 5 can engage in the detent recess 6 or 6*a*. This is shown in FIG. 1. In this case the detent recess 6 is located at the edge of the detent lever 2 and detent recess 6*a* is spaced apart from detent recess 6 on the edge of the detent lever 2.

Figure 2:
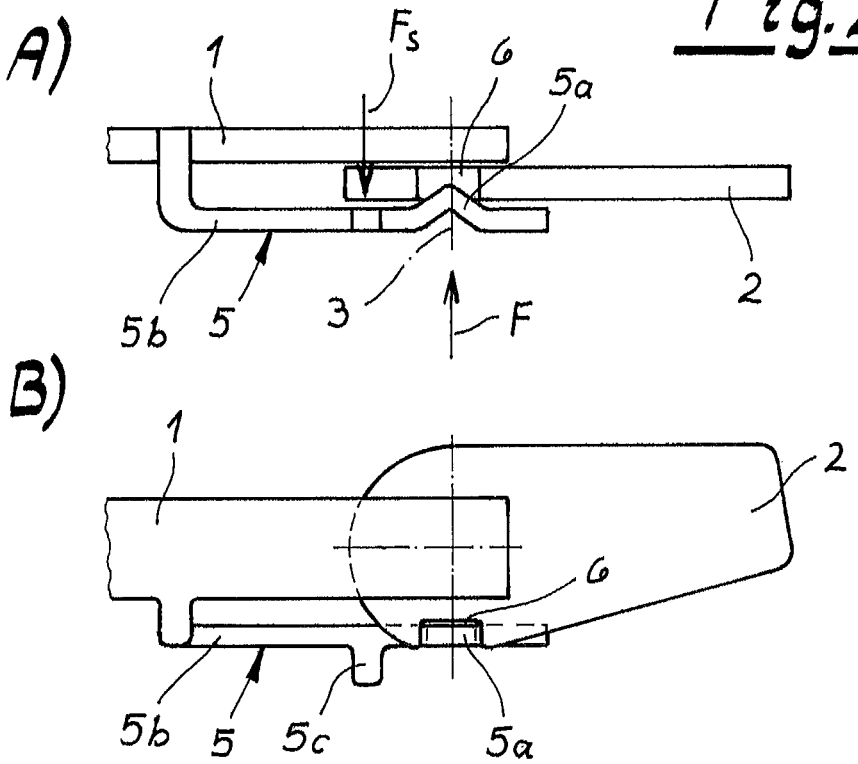
FIG. 2*a* shows a view of a modified version.
FIG. 2*b* shows a view from the top onto the version of FIG. 2*a*

Alternatively, it is also feasible that the detent spring 5 with its detent cam 5*a* perpendicular to the detent lever 2, engages in the detent recess 6 or 6*a*. This is shown in FIGS. 2*a* and 3*a*. With this option it has also proven to be advantageous for the detent cam 5*a* to be provided in form of a U-shaped or V-shaped design of the spring extension arm 5*b*. Such a U-shaped or V-shaped design or detent cam 5*a* provided in such a way can actually not only engage in a recess 6 or 6*a* on the detent lever 2 but can, in principle, also extend through a recess of the fixed lever 1, as shown in FIGS. 3*a* and *b*. With the aid of the switching arm 5*c* the detent spring 5 or its detent cam 5*a* can be pivoted out of its detent recess 6 or 6*a*. For this purpose, the switching arm 5*c* can be connected at an angle to the spring extension arm 5*b*. This is shown by a dashed/dotted line in FIG. 1. The solid line option shows, however, a situation in which the switching arm 5*c* is co-linearly connected to said arm as an extension. In this way the switching arm and 5*c* and the spring extension arm 5*b* together form an actuation rocker in relation to the articulation point 7 between the detent spring 5 and the fixed lever 1.

The detailed drawing of FIG. 1 also shows that the detent spring 5 can be provided with an additional catch 8. This additional catch 8 can engage in a recess 9 fixed in relation to the housing. In this way, the additional catch 8 can absorb loads in this area. The additional catch 8 is also arranged between the articulating point 7 between the detent spring 5 and the fixed lever 1 and the projection 5*a*.

All embodiments are characterized by the detent lever 2 being connected to the fixed lever 1 as its extension via rotation axis 3. In this arrangement, both levers 1, 2 can be arranged parallel to one another. In order to remove the projection 5*a* from the detent recess 6 or 6*a*, the switching arm 5*c* only has to be acted upon in the version shown in FIG. 1. Alternatively or in addition, the process described in embodiment examples of FIGS. 2*a, b* and 3*a, b* can also be employed. In this case a switching force $F_S$ acts on detent spring 5 in such a way that the switching force $F_S$ is directly applied to the U- or V-shaped detent spring 5 or detent cam 5*a*, designed in this way. The detent lever 2 can in any case be easily returned from its base position to the deflection position and back, so that the described quick release function can be directly realised.

Naturally, the invention is not limited to such a quick-release function. Instead, the described cooperation between levers 1, 2 can also be used for any other possible areas of application in a motor vehicle door lock.

The invention claimed is:

1. Motor vehicle door lock comprising an actuation/locking lever mechanism with a first lever and a second lever, with both levers being couplable with each other in at least two different relative positions, wherein, when coupled together, the first lever and the second lever pivot together, wherein the second lever defines at least two detent recesses, wherein the first lever comprises a detent spring connected thereto for engagement with one of the detent recesses of the second lever to define two different positions where the first and second lever are coupled together, wherein the detent spring contains a switching arm, by aid of which the detent spring can be selectively pivoted out of one of the detent recesses, wherein the first lever does not change its position in relation to the second lever and the second lever with the detent recess is a detent lever arrangeable in different detent positions relative to the fixed lever, and wherein the detent spring is movable into and out of engagement with the detent recesses of the second lever to decouple the first and second levers and permit pivoting of the detent lever relative to the fixed lever.

2. Motor vehicle door lock according to claim 1, wherein the detent spring contains a detent cam and a spring extension arm.

3. Motor vehicle door lock according to claim 2, wherein, the spring extension arm is connected to the first lever at an articulating point and that the detent cam engages in one of the detent recesses on the second lever.

4. Motor vehicle door lock according to claim 3, wherein the spring extension arm and the switching arm are arranged co-linearly or angled to each other, in particular perpendicularly.

5. Motor vehicle door lock according to claim 4, wherein the spring extension arm contains a catch engaging in a recess fixed in relation to the housing in addition to the detent cam.

6. Motor vehicle door lock according to claim 5, wherein the catch is arranged between the articulation point of the detent spring and the projection.

7. Motor vehicle door lock according to claim 2, wherein the detent cam is designed as a projection connected to the spring extension arm.

8. Motor vehicle door lock according to claim 2, wherein the detent cam is provided as a U- or V-shaped spring extension arm of the detent spring.

9. Motor vehicle door lock according to claim 2, wherein the detent spring contains a switching arm, by aid of which the detent spring can be selectively pivoted out of one of the detent recesses.

10. Motor vehicle door lock according to claim 9, wherein that the spring extension arm and the switching arm are arranged co-linearly or angled to each other, in particular perpendicularly.

11. Motor vehicle door lock according to claim 9, wherein the spring extension arm contains a catch engaging in a recess fixed in relation to the housing in addition to the detent cam.

12. Motor vehicle door lock according to claim 1, wherein the detent lever is mounted on the fixed lever in a rotation axis.

13. Motor vehicle door lock according to claim 12, wherein the detent spring produces a spring force acting on the detent lever in the area of the rotation axis.

14. Motor vehicle door lock according to claim 13, wherein the detent spring engages in one of the detent recesses with its detent cam on the side of the detent lever.

15. Motor vehicle door lock according to claim 14, wherein the detent spring engages in one of the detent recesses with its detent cam perpendicular to the detent lever.

16. Motor vehicle door lock according to claim 1, wherein the detent spring engages in one of the detent recesses with its detent cam perpendicular to the detent lever.

17. Motor vehicle door lock according to claim 1, further comprising a triggering lever, wherein, when the first and second lever are coupled together in a first position, the detent lever cannot engage the triggering lever and wherein, when the first and second lever are coupled together in a second position, the detent lever engages the triggering lever when the first and second levers pivot together.

* * * * *